United States Patent [19]

Rozenwasser

[11] Patent Number: 4,934,135

[45] Date of Patent: Jun. 19, 1990

[54] FINE JEWELRY ROPE CHAIN

[76] Inventor: David Rozenwasser, 26 Har Dafna Street, Savion, Israel

[21] Appl. No.: 286,657

[22] Filed: Dec. 19, 1988

[30] Foreign Application Priority Data

Nov. 10, 1988 [IL] Israel ..... 88356

[51] Int. Cl.[5] ..... F16G 13/00

[52] U.S. Cl. ..... 59/80; 59/16; 59/20

[58] Field of Search ..... 59/80, 16, 3, 20, 25, 59/35.1, 78, 83

[56] References Cited

U.S. PATENT DOCUMENTS

| | | | |
|---|---|---|---|
| 2,300,624 | 11/1942 | Keene | 59/17 |
| 2,617,250 | 11/1952 | Kunzmann et al. | 59/17 |
| 4,493,183 | 1/1985 | Bucefari et al. | 59/20 |
| 4,503,664 | 3/1985 | Allazzetta et al. | 59/16 |
| 4,651,517 | 3/1987 | Benhamou et al. | 59/16 |

FOREIGN PATENT DOCUMENTS

| | | | |
|---|---|---|---|
| 2829854 | 1/1980 | Fed. Rep. of Germany | 59/23 |

*Primary Examiner*—David Jones
*Attorney, Agent, or Firm*—Marvin H. Kleinberg; Matthew F. Jodziewicz

[57] ABSTRACT

A rope chain made from precious metals, having tightly interfitting rings of a given cross-section diameter, each ring having a small gap slightly larger than its cross-section diameter to permit one ring to pass through the gap of a second ring, each of said rings having an inner diameter equal to just over X times greater than the ring cross-section diameter, where X is a number equal to or greater than 3, said rope chain being formed by a plurality of assemblies of said rings, in series, each assembly comprising X+1 rings, each ring of said assembly being angularly intertwined with an adjacent ring, each said assembly of rings comprising at least one ring oriented with its gap about 180° removed with respect of the gap of at least one other ring within said assembly, characterized in that each assembly of rings comprises at least one group of two or more adjacent rings having their gaps in the same orientation, said at least two or more adjacent rings being fixedly attached to each other, each of said at least one group of two or more adjacent rings being also fixedly attached to another ring having a gap orientation about 180° removed with respect of the gaps of the rings of said group of two or more adjacent rings, and the end ring of each assembly in the series envelops the other rings of said assembly.

11 Claims, 3 Drawing Sheets

FINE JEWELRY ROPE CHAIN

FIELD OF THE INVENTION

This invention relates to a novel construction for hand-made chains, specifically jewelry chains of the type known as rope chains, and to a method for making same.

BACKGROUND OF THE INVENTION

Rope chains made from precious metals have, for decades, been made largely by hand. The method of making such chains until this very day will now be described in detail with reference to FIGS. 7–10. The basic construction element, or component, of such rope chains is a ring formed of a solid or hollow wire, usually of precious metal, e.g. 14 karat gold. The ring 1 shown in FIG. 7 has an opening or gap 2 formed therein. This gap 2 has a narrow dimension 3 at its inner diameter and a wider dimension at its outer diameter.

The solid wire forming the ring (FIG. 8) usually has flattened sides 4 and rounded ends 5 which give the ring 1 a major diameter ($d_w$) 6 and a minor diameter 7. The cross-section of the wire forming the ring 1 may also be of generally circular cross-section. The gap 2 of ring 1 is substantially larger than the minor diameter 7 and is slightly larger than the major diameter $d_w$ at its narrowest dimension 3.

A multiplicity of such rings 1 are intertwined to form, in outward apperance, a double helix, as shown in FIG. 9, which is the format for a standard rope chain. These tightly interfitting ring rope chains are hand-made as follows, based on the prior art teachings.

The ring 1 used for the chain should have an inner diameter ($d_i$) slightly more than X times greater than the major wire diamter $d_w$ 6, and X equals 3 or an odd number greater than 3, e.g. 3.4. See U.S. Pat. No. 4,651,517 for a detailed discussion. Referring now to FIGS. **10*a*–10*d*, the first ring forming the rope chain will be termed herein the a ring. It is the first of a series of four rings forming a ring assembly. In the example of FIGS. 10*a*–10*d*** X equals 3.

The relative orientation of the rings forming the rope chain is important. The a ring is initially oriented (manually) so that its gap, designated **20*a*, lies in a predetermined direction, e.g. facing generally upwardly, as in FIG. 10*a*. The second ring of this assembly, designated the b ring, is passed through the gap 20*a* of the a ring, with the gap 20*b* of the b ring facing downwardly at about 180° removed from the a ring gap 20*a*, as shown in FIG. 10*b*. The a and b rings are juxtaposed and intertwined so that they lay against each other, with the periphery of the b ring lying against the periphery of the a ring, to the greatest extent possible, thereby creating a relatively large central opening 30** with the pair of intertwined abutting a and b rings. The plane of the a ring lies in parallel to the plane of the paper, and the plane of the b ring is slightly skewed from the a plane.

The gap **20*c* of the third ring c is then passed through the gap 20*b* of the b ring and over the minor diameter of the a ring and laid angularly against the a and b rings, the gap 20*c* of the c ring lying in the same orientation as the gap 20*a* of the a ring, and as shown in FIG. 10*c*, but with its plane more greatly skewed than the a and b rings. A central opening 30*a*** still remains within the now three intertwined rings, a, b and c. The planes of each of the rings differ from each other by perhaps about 20° because of their angular abutment. In the case where X equals 5, the planes of the rings would differ from each other by about 15°.

Turning now to FIG. **10*d*, the gap 20*d* of a fourth ring d is now passed over the a, b and c rings, through the central opening 30*b*, and thereby envelopes the a, b and c rings. The c ring is laid against the other rings (a–c) and its plane lies approximately 20° from the plane of the c ring. The gap 20*d* of the d ring is disposed in the same orientation as the gap 20*c*** of the d ring.

The just-described intertwining and orientation of a–d rings permits the continuation of the intertwining of additional assemblies of rings (of four rings each, where X=3, or six rings each when X=5 etc.) to create a "double helix" rope chain of a desired length. The adding on of an additional assembly of four rings is a repetition of the orientation previously described with reference to the a–d series, but the planes of this second assembly lie at approximately 90° to the planes of the respective rings in the first assembly.

It is to be noted that the gaps of the first and third ring additions of a second ring assembly abut the previous first and third rings, and the second and fourth rings pass through the gaps of the previous second and fourth rings and that the relative orientations of the gaps of the rings altenate between adjacent rings about 180°. Thus, as far as the operator is concerned, he or she is always alternating the gap orientation while intertwining each additional ring.

After building up the rings in the manner just described, to form the double helix rope chain (FIGS. **10*a*–10*d*, the rings are held in the desired juxtaposition temporarily by thin metal wire 25 wrapped about the rings (FIG. 9). Then solder S is intermittently applied, e.g. to every pair of adjacent rings ususally at two points of the external periphery thereof. The wire 25** is then removed. The intermittent soldering S results in a rope chain wherein every ring pair is slightly movable, with respect to its adjacent ring pairs, and results in a chain having the desired flexibility for forming a necklace or bracelet.

Rope chains having ring dimeter ratios with X being an odd number greater than 3 where disclosed in U.S. Pat. No. 4,651,517, which disclosure is incorporated herewith by reference.

As is apparent from the above description, the formation of such tight fitting rope chains is extremely complex and until now they have been manufactured almost entirely by hand, particularly by skilled and expert workmen. Because of the extremely small size of these rings, the linking of the open rings requires great dexterity and manual agility and continuous concentration on the part of the workmen. Since the rings must be overturned alternately through 180° and simultaneously located so as to embrace a plurality of preceding rings, errors in the manual formation are far from infrequent. Thus the production of these chains by hand involves long periods of time and consequently is very labour-intensive which adds significantly to the selling price.

It is an object of the present invention to provide a fine jewelry rope chain produced manually with significant time saving.

It is a further object of the invention to provide a method for hand manufacturing a greater variety of fine jewelry rope chains with standard open rings than has been possible heretofore.

SUMMARY OF THE INVENTION

These and other objectives are achieved by providing a rope chain made from precious metals having tightly interfitting rings of a given cross-section diameter, each ring having a small gap slightly larger than its cross-section diameter to permit one ring to pass through the gap of a second ring, each of said rings having an inner diameter equal to just over X times greater than its cross-section diameter, where X is a number equal or greater than 3, said rope chain being formed by a plurality of assemblies of said rings, in series, each assembly comprising X+1 rings, each ring of said assembly being angularly intertwined with an adjacent ring, each of said assembly of rings comprising at least one ring oriented with its gap turned about 180° with respect of the gap of at least one other ring within said assembly, characterized in that each assembly of rings comprises at least one group of two or more adjacent rings having their gaps in the same orientation, said at least two or more adjacent rings being fixedly attached to each other, each of said at least one group of two or more adjacent rings being also fixedly attached to another ring having a gap orientation about 180° with respect of the gaps of the rings of said group of two or more adjacent rings, and the end ring of each assembly in the series envelops the other rings of said assembly.

In the conventional method of manufacturing tightly fitting intertwined rope chains, the major labour cost involves the assembling of the rings in their proper orientation within each other. This assembling operation can account for between 80–90% of the labour cost. As was stated earlier, the workman has to take special care to introduce one ring within the other rings in proper orientation, i.e. each ring must be with its gap turned 180° with respect of the adjacent ring gap. Thus such an operation involves inserting one ring within another or within a group of rings and turning the ring to its proper gap orientation. We have discovered that it is possible to manufacture rope chains with tightly fitting intertwined rings by usiing multiple adjacent rings oriented with their gaps in the same direction. This produces a labour saving for every ring which is introduced into a ring assembly, that does not have to be turned 180°. This novel and variable arrangement of ring orientations permits the manufacture of rope chains having variable ring assemblies of both even and odd numbers, i.e. where the ratio of the inner diameter of the ring to its cross-section, X, can be any even or odd number from 3 and above.

Manufacturing rope chains according to this invention with ring assemblies having at least one group of two or more adjacent intertwined rings oriented with their gaps in the same direction is made possible by fixing the similarly oriented adjacent rings to one another, so that each group of such similarly oriented rings can be considered and treated as if it were a single ring with a single gap.

The precious metals for fine jewerly rope chains of this invention may be gold, platinum, silver and their alloys.

BRIEF DESCRIPTION OF THE DRAWINGS

The invention will now be discussed with reference to the drawings, in which -

Turning now to FIG. 1, this shows schematically two ring assemblies in series in accordance with the prior art, where X=3, i.e. three rings a, b and c of the first assembly and aa, bb and cc of the second assembly are intertwined with alternating gap orientations of 180° and the fourth ring d and dd of the first and second assemblies respectively is looped 50, 51 through the first three rings. Thus rings a, c, aa and cc have their gaps 40*a*, 40*c*, 40*aa* and 40*cc*, respectively turned 180° with respect of the gaps of rings b, d, bb and dd. Rings d and dd envelop (50, 51) the previous three rings of their respective assemblies. Each pair of alternating rings is soldered together $S_1$ leaving room for movement between pairs of rings a-b, c-d, aa-bb and cc-dd. Because of this alternating ring gap orientation, all the rings except ring a must be inserted into the group of rings by turning 180° with respect of the previous ring, thus requiring additional time consuming manipulation. Let us now compare this prior art ring assembly with the invention as illustrated in FIG. 2. Here we see two ring assemblies, a to d and aa to dd, each having one group of three adjacent rings b-c-d and bb-cc-dd with the same gap orientation and only two rings, a and aa, with gaps oriented 180° with respect of these groups of rings. The rings d and dd envelop (52, 53) the previous rings of their respective ring assemblies. This arrangement of rings requires that the groups of rings, b-c-d- and bb-cc-dd, be soldered S together to form single units. The last ring d and dd of each assembly is, in this case, soldered $S_1$ to the first ring aa, ee of the next assembly. In this example, the number or rings which must be manipulated for each assembly and turned 180° with respect to the previous ring is only one, which is a ⅔ saving of time for this type of manipulation. Overall, this arrangement can save approximately 18–20% of labour costs in the manufacture of such a rope chain. As will become apparent, this labour saving increases relative to the prior art method as the number of adjacent rings having the same gap orientation in a group increases.

Figure 10A:
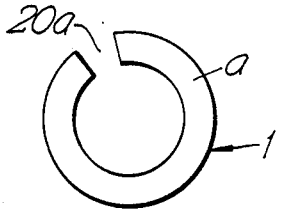
FIGS. 10*a*–10*d* show, in sequence and in perspective, the build-up of prior art rope chains from open rings.
Figure 10B:
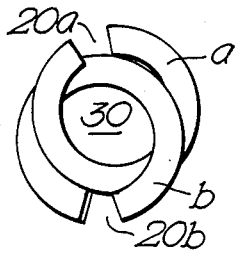
Figure 10C:
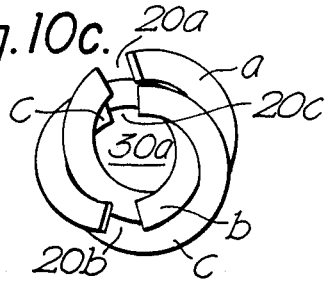
Figure 10D:
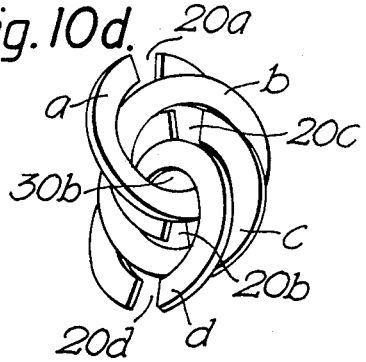

It is to be understood that FIGS. 1–6 represent only schematic illustrations of the gap orientation of the rings. In reality the rings are actually laid angularly against one another, being intertwined, with the plane of each ring differing from its adjacent ring as illustrated in FIG. 10*d* for assemblies in which X=3.

Figure 1:
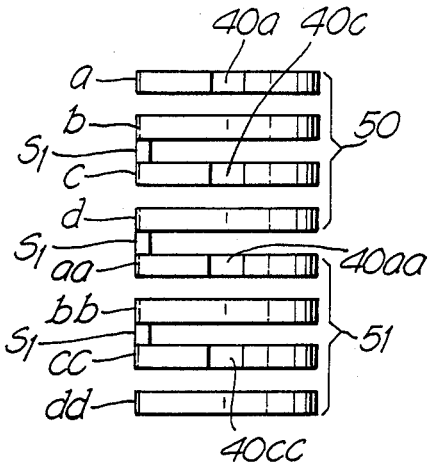
FIG. 1 is a schematic representation of a section of rope chain with the ring gap orientation alternating 180° as in the prior art, and wherein $d_i$ is slightly greater than 3 times the ring cross-section $d_w$.
Figure 2:
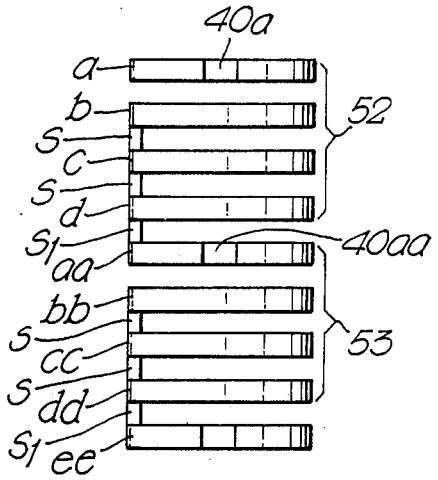
FIG. 2 is a schematic representation of a section of rope chain in accordance with the invention, also having a 3+:1 ring diameter to cross-section ratio as in FIG. 1.
Figure 3:
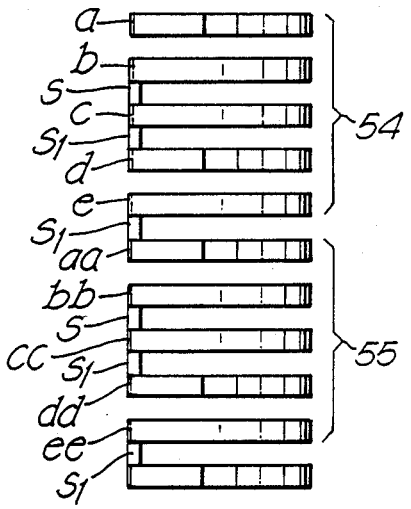
FIG. 3 is a schematic representation of a section of rope chain according to the invention having a ring diameter to cross-section ratio of 4+:1.

Referring now to FIG. 3, this schematically illustrates a section of rope chain having a ring diameter to cross-section ratio of 4+:1. Each ring assembly comprises 5 rings. In this case, rings a, d, aa and dd have their gaps in one orientation and rings b, c, e, bb, cc and ee in the opposite orientation. Rings b and c form one group and rings bb and cc form another group of adjacent rings having similar gap orientation. In this type of assembly, the rings in each group, b-c and bb-cc, are soldered to each other S, and the groups are soldered $S_1$ respectively to rings d and dd, which have their gaps oriented 180° from the rings in the groups. Rings e and ee envelop the preceding rings (54, 55) of their respective ring assemblies.

A jewelry rope chain as illustrated in FIG. 3 based on X=4+ has never been thought to be possible.

Figure 4:
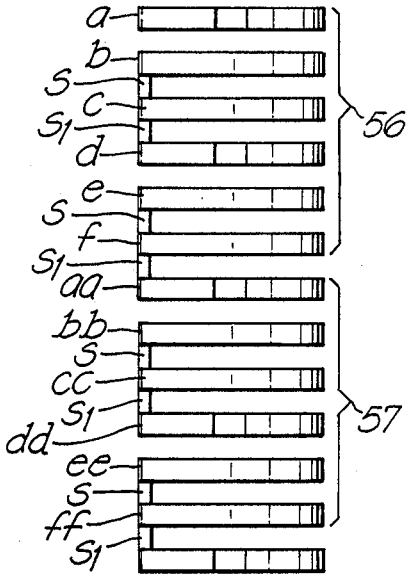
FIG. 4 is a schematic representation of a section of rope chain in accordance with the invention, wherein the ring diameter to cross-section is 5+:1.

Referring now to FIG. 4, this schematically illustrates a section of rope chain having a ring diameter to cross-section ratio a little over 5:1. Each ring assembly comprises 6 rings. In this arrangement, rings a, d, aa and dd have their gaps in one orientation and rings b, c, e, f, bb, cc, ee and ff in the opposite orientation. The groups of adjacent rings b-c, e-f, bb-cc and ee-ff have similar gap orientations. In this arrangement, the rings of each group are soldered S together and the groups in turn are soldered $S_1$ to rings d, aa and dd respectively, which have their gaps oriented 180° from the groups. Rings f and ff envelop their respective ring assemblies (56, 57). This arrangement of rings provides a beautiful rope chain with less labour cost than is possible with the arrangement disclosed in U.S. Pat. No. 4,651,517.

Figure 5:
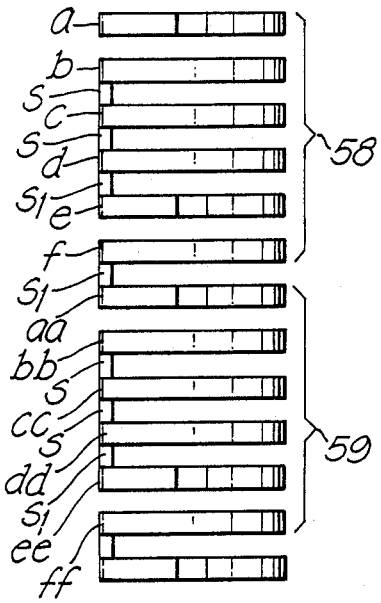
FIG. 5 illustrates schematically a section of another preferred rope chain in accordance with the invention having a ring diameter to cross-section ratio of 5+:1.

FIg. 5 illustrates another variation in the orientation of the rings in an assembly having an inside ring diameter to cross-section ratio of just over 5:1. In this arrangement there are groups of three adjacent rings (b-c-d and bb-cc-dd) having the gap in the same orientation for each ring assembly. These rings are soldered together S and the groups b-c-d and bb-cc-dd are solderes $S_1$ to another ring e and f respectively in the assembly having an opposite gap orientation. Rings f and ff envelop (58, 59) their respective ring assembly.

Figure 6:
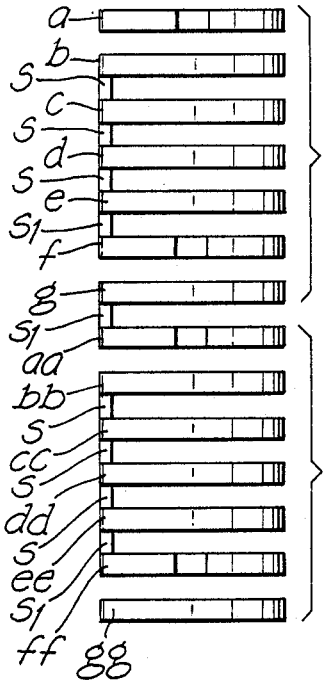
FIG. 6 illustrates schematically the invention with rings having a 6+:1 ring diameter to cross-section ratio.
Figure 7:
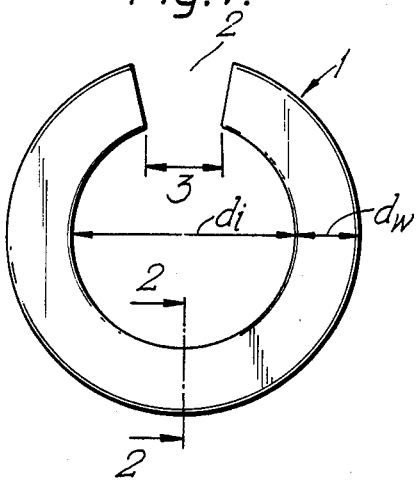
FIG. 7 is a plan view of an open ring used for making rope chains.
Figure 8:
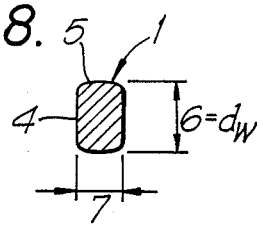
FIG. 8 is a cross-section of the prior art wire forming the ring of FIG. 7 taken along the lines 2—2.
Figure 9:
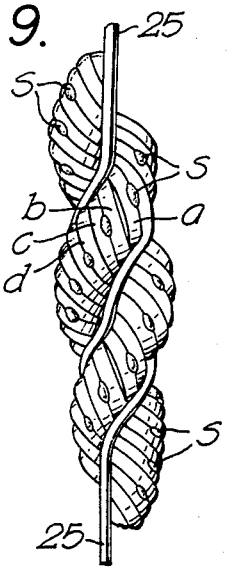
FIG. 9 is a side elevation showing a section of a prior art finished rope chain.

FIG. 6 illustrates a ring arrangement having an inside ring diameter to cross-section of just over 6:1 comprising 7 rings in each assembly. This arrangement illustrates two ring assemblies, each with a group of four adjacent rings, b, c, d, e and bb, cc, dd, ee, having the same ring gap orientation soldered S together. These groups are further soldered $S_1$ to rings having opposite gap orientations f and ff respectively. The time saving with respect of ring manipulation in this arrangement is even greater than in the previous illustrations.

It should also be noted that FIGS. 4 and 6 illustrate fine jewelry rope chain configurations that were not contemplated nor achievable according to the prior art, where only odd number ratios X of ring diameter to cross-section were considered.

This invention makes it possible to manufacture fine jewelry rope chains with assemblies were X may be an even or odd number having from two to X number of adjacent rings with the same gap orientation.

The ratio of the ring inner diameter to ring cross-section is preferably X.1 to X.X and most preferably X.1 to X.7 wherein X is a number equal to 3 or more. Preferably X equals 4 to 7.

It is of course understood that hollow rings can also be used to provide further cost saving, since less precious metal is then used.

I claim:

1. A rope chain made from precious metals, having tightly interfitting rings of a given cross-section diameter, each ring having a small gap slightly larger than its cross-section diameter to permit one ring to pass through the gap of a second ring, each of said rings having an inner diameter equal to just over X times greater than the ring cross-section diameter, were X is a number equal to or greater than 3, said rope chain being formed by a plurality of assemblies of said rings, in series, each assembly comprising X+1 rings, each ring of said assembly being angularly intertwined with an adjacent ring, each said assembly of rings comprising at least one ring oriented with its gap about 180° removed with respect of the gap of at least one other ring within said assembly, characterized in that each assembly of rings comprises at least one group of two or more adjacent rings having their gaps in the same orientation, said at least two or more adjacent rings being fixedly attached to each other, each of said at least one group of two or more adjacent rings being also fixedly attached to another ring having a gap orientation about 180° removed with respect of the gaps of the rings of said group of two or more adjacent rings, and the end ring of each assembly in the series envelops the other rings of said assembly.

2. A rope chain of claim 1, wherein the said group of at lest two adjacent rings having their gaps in about the same orientation are held fixedly together by solder.

3. A rope chain of claim 1, wherein X=3 and each assembly of rings comprises from two to three adjacent rings having the same gap orientation.

4. A rope chain in accordance with claim 1, wherein X=4 and each assembly of rings comprises from two to four adjacent rings having their gaps in the same orientation.

5. A rope chain in accordance with claim 1, wherein X=5 and each ring assembly comprises from tow to five adjacent rings having the same gap orientation.

6. A rope chain in accordance with claim 1, wherein X=5 and each ring assembly comprises two groups of two adjacent rings with the same gap orientation.

7. A rope chain in accordance with claim 1, wherein X=6 and each ring assembly comprises a group of from two to six adjacent rings having the same gap orientation.

8. A rope chain in accordance with claim 1, wherein X=7 and each ring assembly comprises a group of from two to seven adjacent rings having the same gap orientation.

9. A rope chain in accordance with claim 1, wherein the rings are made of precious metals selected from gold, platinum and silver or their alloys.

10. A chain as in claim 1, wherein the rings have hollow cores.

11. A chain as in claim 1 having a ratio of inner ring diameter to ring cross-section diameter ranging from X.1 to X.7, where X equals any number of 3 and above.

* * * * *